US005534895A

United States Patent [19]

Lindenfelser et al.

[11] Patent Number: 5,534,895

[45] Date of Patent: Jul. 9, 1996

[54] ELECTRONIC AUTO-CORRECTION OF MISALIGNED SEGMENTED PRINTBARS

[75] Inventors: William M. Lindenfelser, Rochester; Frederick A. Donahue, Walworth, both of N.Y.

[73] Assignee: Xerox Corporation, Stamford, Conn.

[21] Appl. No.: 269,319

[22] Filed: Jun. 30, 1994

[51] Int. Cl.[6] ..... B41J 29/393

[52] U.S. Cl. ..... 347/19; 347/12

[58] Field of Search ..... 347/12, 13, 15, 347/19, 37, 40, 41, 42

[56] References Cited

U.S. PATENT DOCUMENTS

| | | | |
|---|---|---|---|
| 4,709,245 | 11/1987 | Piatt | 347/49 |
| 4,818,129 | 4/1989 | Tanuma et al. | 400/323 |
| 5,049,898 | 9/1991 | Arthur et al. | 347/19 |
| 5,069,556 | 12/1991 | Sasaki et al. | 347/19 X |
| 5,250,956 | 10/1993 | Haselby et al. | 347/19 |
| 5,289,208 | 2/1994 | Haselby | 347/19 |
| 5,297,017 | 3/1994 | Haselby et al. | 347/19 |
| 5,430,469 | 7/1995 | Shioya et al. | 347/40 X |
| 5,442,383 | 8/1995 | Fuse | 347/19 |

*Primary Examiner*—John E. Barlow, Jr.
*Attorney, Agent, or Firm*—Daniel J. Krieger

[57] ABSTRACT

A method and apparatus for automatically adjusting the quality of printing made by a scanning type printhead or printbar upon a recording medium advanced perpendicularly to the scanning direction. The scanning printbar includes sequentially printed segments in which the dots or pixels in a segment are printed simultaneously. A source of illumination is passed across a test pattern having features indicative of printhead alignment and discernible under the illumination. The source of illumination is connected to circuitry with determines the variation in light intensity of the test pattern. A value indicative of the misalignment is calculated and used to correct the timing of firing signals between the sequentially fired banks of nozzles of a printbar.

27 Claims, 7 Drawing Sheets

ELECTRONIC AUTO-CORRECTION OF MISALIGNED SEGMENTED PRINTBARS

FIELD OF THE INVENTION

This invention relates generally to enhancing the print quality made from printbar type printers, and more particularly relates to automatically correcting for the misalignment of a thermal ink jet printbar by electronic control.

BACKGROUND OF THE INVENTION

As is known in the art, thermal ink jet printing systems include printheads or printbars which utilize thermal energy selectively produced by heating elements located in capillary-filled ink channels near channel terminating nozzles or apertures to vaporize the ink momentarily and from temporary bubbles on demand. The nozzles are typically arranged in a linear fashion either in a column or a row. The rapid formation of a temporary bubble causes an ink droplet to be expelled from the printhead and propelled towards a recording medium. U.S. Pat. No. 4,774,530 to Hawkins describes a configuration of a thermal ink jet printhead. The printhead may be incorporated in either a carriage-type printer or pagewidth type printer, The carriage type printer generally has a relatively small printhead containing the ink channels and nozzles. The printhead is usually sealingly attached to a disposable ink supply cartridge and the combined printhead and cartridge assembly is attached to a carriage and is reciprocated to print one swath of information (equal to the length of the column of nozzles) at a time on a stationary recording medium, such as paper. After the swath is printed, the paper is stepped a distance equal to the height of the printed swath so that the next printed swath is contiguous therewith. The procedure is repeated until the entire page is printed. In contrast, the pagewidth printer includes a stationary printhead having a length equal to or greater than the width of the paper. The paper is continually moved past the pagewidth printhead in a direction normal to the printhead length and at a constant speed during the printing process.

Because the printheads have an arrangement of linearly aligned nozzles, the alignment of the printhead or printbar with respect to the paper is very critical. In printheads which print a single line of pixels in a burst of several banks or segments of pixels each printing a segment of a line, misalignment can be particularly noticeable if not properly aligned. An ink jet printhead having banks of nozzles is described in U.S. Pat. No. 5,300,968 to Hawkins. In these printheads, the banks of nozzles are fired sequentially and the nozzles within a bank are fired simultaneously. Such printheads must be precisely oriented with respect to the process direction so that the printing of the last segment, which is delayed in time from the printing of the first segment, results in a line of pixels that is collinear.

Misalignment of the printhead or printbar with respect to the paper can occur in many ways. For instance, misalignment can occur between the printhead and the cartridge, between the cartridge and the carriage, and even between the carriage and the printer itself. Since each of these instances of misalignment results from differing causes, misalignment problems require different solutions. Some solutions to misalignment are described in the following references.

In U.S. Pat. No. 4,709,245 to Platt optical inspection of the position of an orifice plate on a printhead after mounting on a printer is described. The edges of the orifice plate are detected by moving each printhead past a light source and sensing changes in the reflected light.

U.S. Pat. No. 4,818,129 to Tanuma et al. describes a method for correcting bidirectional printing alignment of a serial dot printer. Correctly aligned printing is obtained through switch operations by making a selection of correction amounts stored in a memory. A switch is pressed by an operator to select the appropriate correction amount and the selected correction amount is written into memory. A test pattern can be printed to show any misalignment and whether further correction is necessary.

U.S. Pat. No. 5,049,898 to Arthur et al. describes a disposable printing assembly which includes a memory element stored with data characterizing the assembly. Alignment data reflecting the alignment of the orifice plate to the printhead is determined and stored in the memory element prior to mounting on a printer. Once mounted, the alignment data is read by the printer. Based on the data, the relative timing of firing signals provide to printhead orifii is adjusted according to the stored information in order to minimize printing errors caused by misalignment.

U.S. Pat. No. 5,289,208 to Haselby discloses apparatus and techniques for aligning the operation of the ink jet printhead cartridges of a multiple printhead ink jet swath printer. An optical sensor includes a quad photodiode detector having outputs which indicate horizontal positions of vertical test lines and vertical positions of horizontal test lines.

U.S. Pat. No. 5,297,017 to Haselby et al. discloses apparatus and techniques for aligning the operation of the ink jet printhead cartridges of a multiple printhead ink jet swath printer. First and second printhead cartridges print non-overlapping horizontal test line segments. An optical sensor detects relative positions of the test line segments. The operation of the first and second printhead cartridges is adjusted to correct alignment.

SUMMARY OF THE INVENTION

In accordance with one aspect of the present invention, there is provided a method for adjusting the quality of printing made by printer having a scanning printbar printing upon a recording medium advanced substantially perpendicularly to the scanning direction in which the printbar includes sequentially printed segments. The method includes the steps of printing a pattern having features indicative of printing quality on the recording medium, sensing the features of the pattern, determining a value based on the sensed feature, and adjusting the time period between firing of sequentially printed segments of the printbar based on the value determined in said determining step.

Pursuant to another aspect of the present invention, there is provided an ink jet printer having a scanning printhead carriage moving in a scanning direction and a recording medium advanced substantially perpendicularly to the scanning direction of the scanning printhead carriage. The ink jet printer includes a printhead attached to the printhead carriage and has a linear array of ink ejecting nozzles arranged in banks of nozzles. Nozzles within the banks eject ink simultaneously and the banks of nozzles eject ink sequentially. A printhead timing control means controls ejection of ink from the nozzles. A timing means coupled to a sensor attached to the printhead carriage analyzes signals received from the sensor. Control means determine a value based on the analyzed signal.

Further aspects of the invention include a method of adjusting print quality in a printbar printing upon a recording medium advanced perpendicularly to a scanning printbar tilted at an angle with respect to the advancing direction of the recording medium and having sequentially printed segments. The method includes the steps of printing a first line and a second line on the recording medium, the second line partially overlapping the first line, sensing the distance between overlapping portions of the first line and the second line with a single point sensor, and adjusting the time period between the firing of the sequentially printed segments of the printbar to print aligned strokes of the printbar as a function of the sensed distance.

Other features of the present invention will become apparent as the following description proceeds and upon reference to the drawings, in which:

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
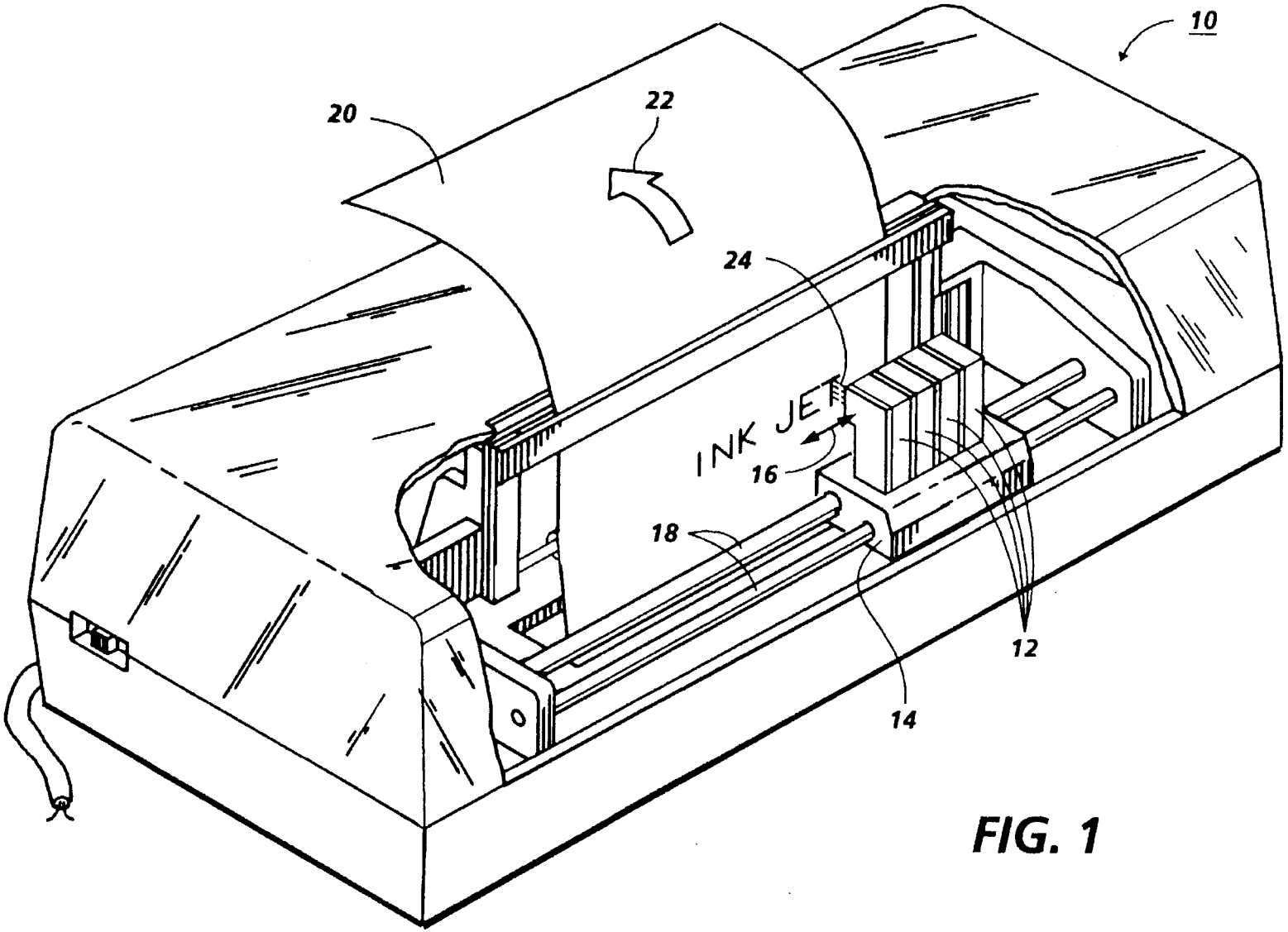
FIG. 1 is a cutaway view of a printer utilizing thermal ink jet printheads attached to a reciprocating carriage.

A typical carriage type multi-color thermal ink jet printing device 10 is shown in FIG. 1. A linear array of ink droplet producing channels is housed in each printhead 12 which can contain an ink supply cartridge therein and which also may be disposable. One or more of the printheads 12 are replaceably mounted on a reciprocating carriage assembly 14 which reciprocates back and forth in the direction of arrow 16 on guide rails 18. The ink droplet producing channels terminate with orifices or nozzles aligned perpendicularly to the carriage reciprocating direction and parallel to the stepping direction of the recording medium 20 such as paper. The stepping direction of the recording medium 20 is shown by arrow 22. Thus, the printheads 12 print a swath of information on the stationary recording medium as it moves in a single direction. Prior to the carriage and printhead reversing direction, the recording medium is stepped by the printing device 10 a distance equal to the printed swath in the direction of arrow 22. Once a printed swath has been printed in one direction, the printheads 12 move in the opposite direction printing another swath of information. Droplets of ink 24 are expelled from the nozzles and propelled to the recording medium in response to digital data signals received by the printing device controller which, in turn, selectively addresses the individual heating elements located in printhead channels a predetermined distance from the nozzles. Current pulses passing through the printhead heating elements vaporize the ink in contact with the heating elements and temporarily produce vapor bubbles which expel the droplets of ink 24 from the array of nozzles. In the alternative, a plurality of printheads may be accurately juxtaposed to form a page width array of nozzles. In this type of configuration, which is not shown, the nozzles are stationary and the paper or recording medium moves passed the page width array of nozzles.

Figure 2:
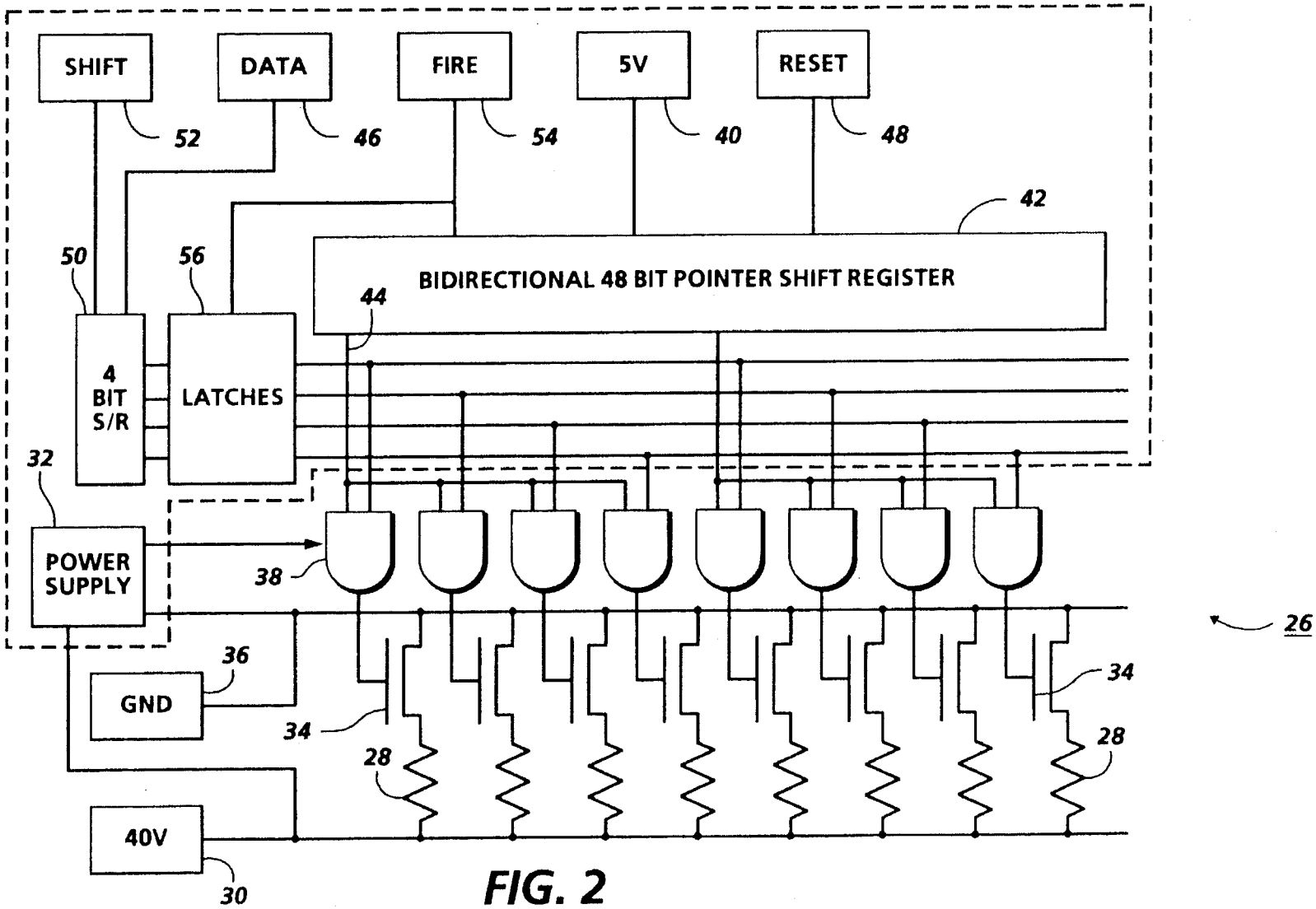
FIG. 2 is a circuit diagram illustrating one embodiment of an ink jet integrated circuit.

FIG. 2 is a schematic diagram illustrating the basic elements of a printhead integrated circuit necessary to selectively expel ink from the array of linearly aligned nozzles. In one particular embodiment, a thermal ink jet integrated circuit or chip 26 includes 192 thermal ink jet heating elements 28 which are powered by a 40 volt supply line 30 produced by a power supply 32. Each of the heating elements 28 is additionally coupled to a power MOS FET driver 34 having one side thereof coupled to a ground 36. The power MOS FET drivers 34 energize the heating elements 28 for expelling ink from the nozzles. Although a thermal ink jet chip 26 can include any number of ink jet heating elements 28, the present invention is applicable to any number and ink jet heating elements 28, however, eight heating elements 28 are shown in FIG. 2 for illustrative purposes.

Control of each of the power MOS FET driver 34 is accomplished by an and gate 38 having the output thereof coupled to the gate of the driver 34. The power supply 32 provides an output of greater than 5 volts and typically of 13 volts. This operating voltage for the and gates 38 enables the power MOS FET driver 34 to be turned on harder through the application of a higher gate voltage than would be available from a 5 volt power supply 40 available from the printer 10.

To reduce the amount of circuitry necessary to individually fire each of the heaters 28, the thermal ink jet integrated circuit 26 controls up to four heaters 28 at a time by using a bidirectional 48 bit pointer shift register 42. The shift register 42 controls four of the and gates 38 at a time. Printing is initiated with a single one bit pointer which begins at the left most side of the bidirectional 48 bit pointer shift register 42 at a line 44 or conductor 44. The pointer bit starts on the left-hand side and propagates to the right-hand side or in the alternative starts on the right-hand side and propagates to the left-hand side depending on the state of a data line 46 at the time a reset line 48 goes high. Bidirectional propagation of the one bit is necessary for bidirectional printing. The length of the shift register 42 depends on the number of heaters 28 fired together and the total number of heaters 28 in the printhead itself. In the FIG. 2 configuration, 192 nozzles would be fired using a bank of 48 shift registers of four bits each as would be understood by one skilled in the art.

When the shift register 42 is reset by the reset line 48, four bits of data are loaded from the data line 46 into a four bit shift register 50. The four bit shift register 50 is shifted by a shift line 52 which receives shift information from a printhead controller as understood by one skilled in the art. The four bits of data, which have been loaded into the four bit register 50, control whether or not a heating element 28 within a block of four heating elements selectively controlled by the shift register 42 will be energized according to the four data bits located in the four bit shift register 50. A fire control pulse received from the printhead controller at a fire line 54 controls the amount of time that individual heaters 28 are energized. During the cycle of the fire control pulse received over the fire line 54, four new bits of information are loaded into the four bit shift register 50. The completion of the fire cycle advances the shift register 42 pointer bit one position and the fire cycle begins again. For 192 nozzles in an array there are 48 fire cycles which are addressed. Once all 192 drop ejectors or nozzles have been addressed, the shift register 42 is reset by the reset line 48. A latch 56 is used to latch the information from the four bit shift register 50 onto each of the individual MOS FETS 34 for energization.

Since four of the individual heater elements 28 are controlled at a time, each of the individual printheads 12 includes a printbar which is divided into 48 segments of four nozzles each. The heating elements 28, within each four nozzle segment, are fired simultaneously if all four of the heating elements are selected for energization. After a first bank of four heating elements 28 have been fired simultaneously, then a second bank of four heating elements 28 is fired. Consequently, banks of four heating elements 28 are fired sequentially one after another until all of the heating elements 28 of a printhead have been fired. Due to the relative motion of the paper 20 and the printheads 12 during scanning and due to the finite amount of time necessary to energize the heaters 28 and to allow for the electronics to prepare for the next firing, a single printed line, resulting from every nozzle of the printhead, is not actually colinear but rather is formed of small line segments four nozzles long which are slightly staggered with respect to one another. The stagger distance is the distance travelled during the firing period.

The stagger distance is relatively small from one bank of four nozzles to the next bank of four nozzles. For instance, at a carriage speed of 15 inches per second and a firing period of 3.2 microseconds, a delay of 48 microinches (1.2 micrometers) results. Multiplying this number by the number of banks of four of the heating elements 28 within a printbar results in a delay or stagger of 57.6 micrometers from the top most nozzle of the printbar to the bottommost nozzle of the printbar. While the stagger distance between individual banks of four heating elements 28 is not particularly noticeable, such error is, however, noticeable at the stitch line or the boundary between two printed swaths.

Figure 3:
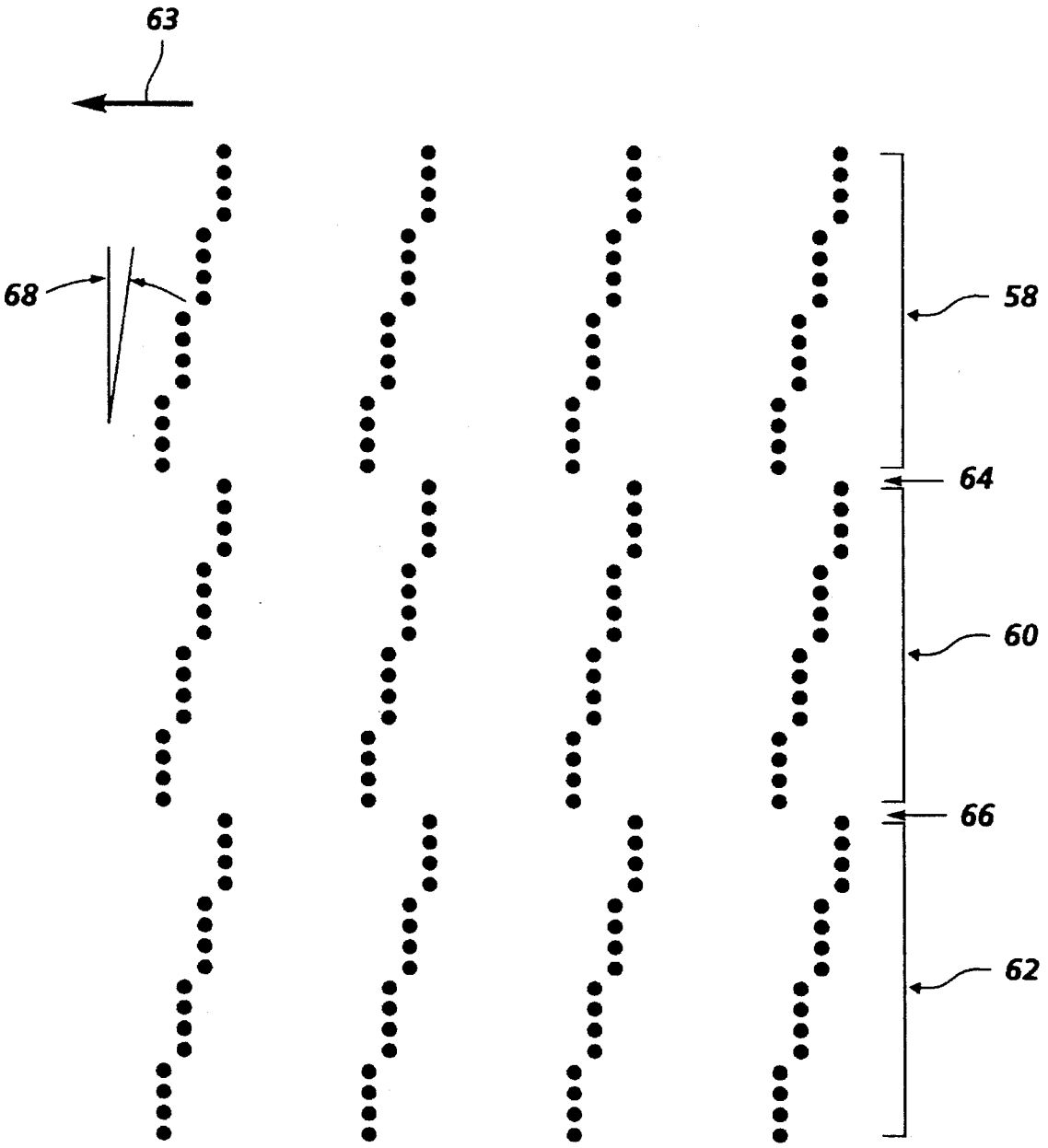
FIG. 3 illustrates an exaggerated depiction of the printing of three swaths of vertical lines, each swath having the length of a column of nozzles on a printbar.

FIG. 3 illustrates the stagger error in a slightly exaggerated fashion for the purposes of clarity. A first swath 58, a second swath 60 and a third swath 62 are shown as being printed one beneath the other. The swaths are printed from right to left in this FIG. as shown by direction arrow 63. Each of the swaths consists of four banks of four nozzles each. Between the first swath 58 and the second swath 60, a stitch line 64 is noticeable between the bottommost nozzle of the printbar printed in the first swath 58 and the topmost nozzle printed by the printbar in the second swath 60. Likewise, a stitchline 66 can be seen between the second swath 60 and the third swath 62.

Because printbars are segmented, the last segment printed by a single printbar is electronically delayed by a predetermined amount of time from the time the first segment was printed to try to overcome this particular phenomenon. In addition to the time delay, the printbar is typically not mounted at a 90° angle with respect to the process direction but is instead tilted at a small angle to allow for the finite amount of time to print all the segments of a printbar. In fact, the misalignment error is proportional to the printbar length and the sin of the angle of deviation. For a given process speed V, a bar length of L, and a total time to print all these segments of the bar $t_{total}$, the angle of deviation from 90° is approximately $\Theta$=arc sin $[(V_p \text{ X } t_{total})]$. This angle is typically a small angle, usually much less than 1°. Mechanical alignments of this small angle are, however, difficult to obtain. As an example, if a printhead has 32 segments of four heating elements each having a total length of 0.427 inches, the tilt angle necessary to overcome the problem of printing with a segmented printbar is approximately 0.14 degrees. An alignment angle error, slightly exaggerated, is shown as angle 68.

Using this calculated tilt angle, an extra offset or bias is made to the tilt angle. During printing the individual blocks or segments of the printbar are fired at a reduced frequency thereby resulting in lines which appear precisely aligned.

This electronic method is especially useful in high speed thermal ink jet printers having longer printheads enabling commensurately higher print speeds which, in turn, causes larger alignment problems due to the longer length of the printhead. While such a method is useful, it is not totally effective since the typically small angle necessary to overcome misalignment is quite difficult to hold to the small fractional tolerance which vary from printhead to printhead due to manufacturing tolerances. In addition, such angles are subject to change with time.

To overcome these problems, the present invention includes introducing a pre-aligned tilt angle to the printhead to overcompensate for the staggered lines and corrects for the overcompensation by increasing the delay between the firings of the banks of jets. Consequently, the prealigned tilt angle is not subject to close tolerances since any deviation of the tilt angle can be corrected for increasing the delay between firings of the individual banks of jets.

The present invention is an electronic method to enhance print quality from printbar types of printers especially those using segmented printbars. An electronic autocorrection scheme addresses the problem of angular misalignment of the printbar and uses a sensor controller actuator subsystem for automatic correction of the misalignment. By selecting an alignment correction feature of a printer, an operator causes a special diagnostic print pattern to be printed which typically includes lines parallel to the process direction and perpendicular to the scanned direction.

Figure 4:
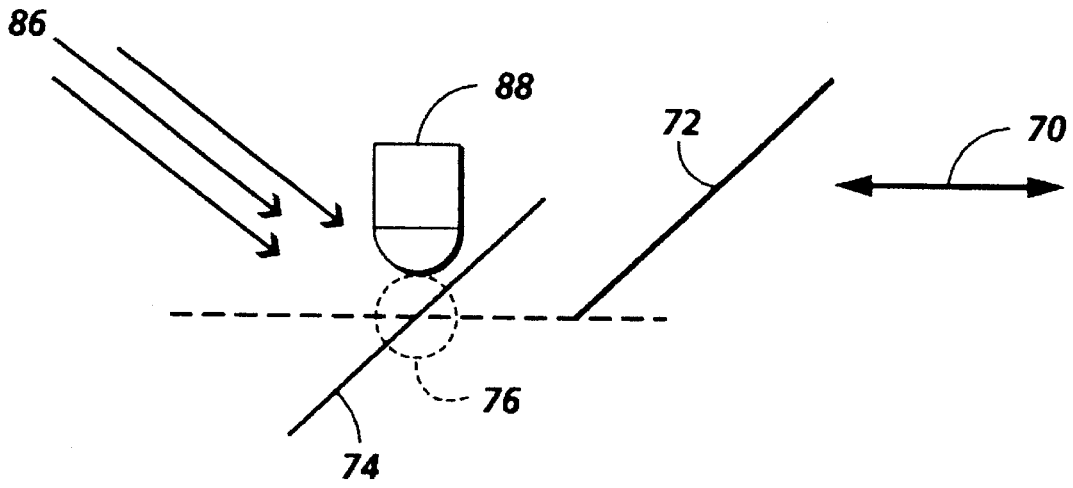
FIG. 4 illustrates a diagrammatic depiction of a sensor scanning a test pattern printed by the printer.
Figure 5:
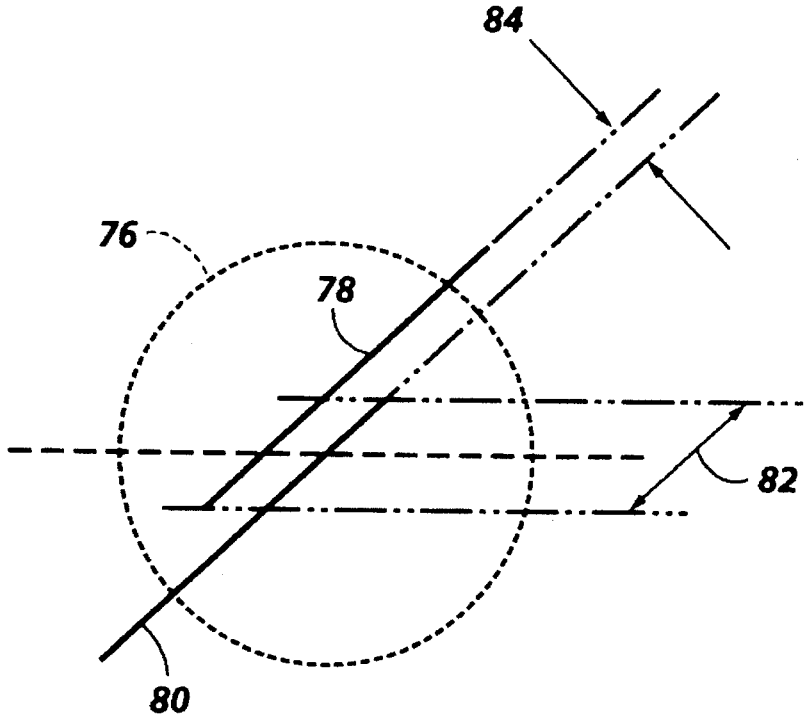
FIG. 5 illustrates an exploded view of the test pattern of FIG. 4 consisting of two overlapping lines.

FIG. 4 illustrates a scan direction 70 of a printbar 72, here illustrated as a single line. In reality, the printbar 72 scans in the scan direction 70 and prints a diagnostic test pattern 74 consisting of two single pixel wide lines as shown in greater detail in FIG. 5. The circled portion 76 of FIG. 4, illustrated as a single pixel wide line 74, is actually two lines printed in two passes of the printbar 72. A first line 78 is printed by a first scan of the printbar 72 and a second line 80 is printed subsequent thereto by a second scan of the printbar 72. The paper advance mechanism of the printer advances the paper a partial swath height to cause the first line 78 from the previous scan to slightly overlap the second line 80 along the scanning direction or a given axis. If the printbar is slightly misaligned, and if the timing delay between segments of the printbar is incorrect, a pattern shown in FIG. 5, is printed which includes unaligned first line and second line 80. The amount of overlap of the first line and second line is shown as arrowed line 82. Due to the misalignment of the printhead, the first line 78 and the second line 80 are slightly separated by a distance 84.

To improve printing, the separation distance 84 between the first line 78 and the second line 80 must be made as small as possible in subsequent operations.

Figure 6:
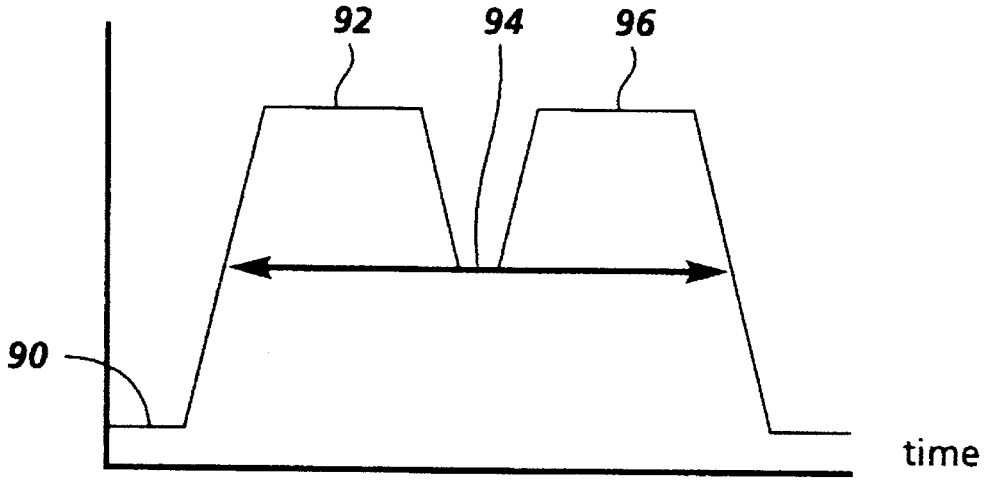
FIG. 6 is a timing diagram showing an output of the sensor of FIG. 4.

To reduce the separation distance, incident light 86 from a light source such as a light emitting diode illuminates the pattern 74 and the separation distance between lines 78 and 80 comprising pattern 74 is calculated. A sensor is passed over the line 74 to determine the distance between the first line 78 and the second line 80. The sensor 88 includes a light source, typically a light emitting diode, and a photodiode for discerning the change in contrast of the pattern, and suitable inexpensive optics. For instance, one pixel of an image input terminal (IIT) scanning bar is acceptable. As shown in FIG. 6, the sensor 88 generates an output over time which indicates the changes in light intensity as the sensor 88 passes from the initial lead edge of the first line 78 to the final trail edge of the second line 80. Using an open collector type of sensor, the signal level is high when light intensity is low. Before the sensor 88 crosses the first line 78, a fairly large amount of light intensity is seen which is shown at 90 in FIG. 6. Once the sensor begins to cross the first line 78, the amount of light decreases and is shown here as 92. As the sensor travels between the first line 78 and the second line 80, the amount of light begins to increase, as shown at 94, until the sensor crosses the second line 80 at 96 wherein the amount of available light has decreased.

By using a single point sensor as described and by using the capability of the printer to partially overlap lines by a partial advance of the recording medium, any problems with alignment of the sensor are avoided. For instance, it is possible to print non-overlapping lines and to use a sensing bar having a defined length to determine the distance between the printed non-overlapping lines. Such a system, however, is not preferred, since the sensing bar could misaligned, thereby preventing accurate correction of a misaligned printbar. A single point sensor requires no axial alignment.

Figure 7:
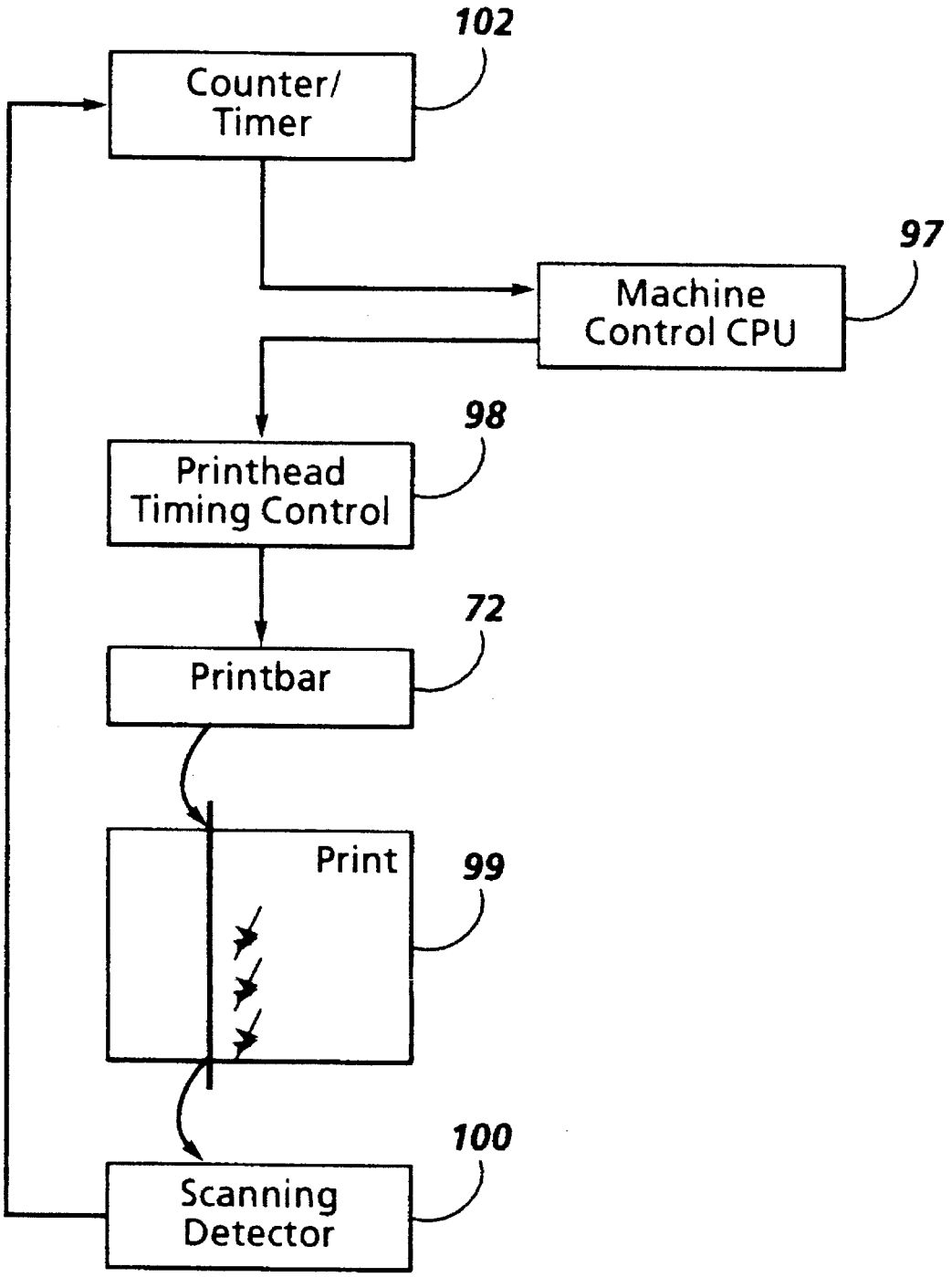
FIG. 7 is a block diagram of the electronic circuitry to effect automatic correction of misaligned segmented printbars.

FIG. 7 illustrates the electronic circuitry in block diagram form to effect automatic correction of the misaligned segmented printbars. The printer includes a machine control central processing unit (CPU) 97 which controls movement of the printhead carriage and printing by the printhead through a printhead timing control unit 98 which, in turn, controls the timing of the firing of the printbar 72 having the circuit of FIG. 2 when making a print 99. Once the print 98, as shown in FIGS. 4 and 5, is made a scanning detector 100, including the illumination source for generating illumination 86 and the sensor 88 is passed across the printed line 74 as just described. The sensor 88 generates the output signal of FIG. 6. A counter timer 102 analyzes the output signal of the sensor 88 to determine the amount of time it took for the scanning detector 100 to cross from the lead edge of the first line to the trail edge of the second line. By knowing the scanning speed of the scanning detection 100 travelling across a printed page and by accumulating statistics on the running average elapsed time to scan across the test pattern, the central processing unit 94 determines the distance between the line 78 and the line 80. The calculated distance is used to correct for the best image using this information.

The printhead timing control 98, which is typically digital logic, is used in printbar printers to produce one or more control signals that govern the data being sent to the printhead. The date includes a fire bank signal which determines the order in which information is printed and the timing of when that information is printed. The fire bank signal is typically a series of periodic pulses or a square wave signal that typically performs two functions: (1) In its active state, its pulse width controls the duration of the firing of the jets within an individual bank. This time period is critical to the successful formation of ink droplets at a given volume and at the printhead speed. This particular parameter remains at a value required by the print process; (2) the time period between pulses determines the relative position of drops on the page by varying the amount of time between the firing of adjacent banks of nozzles.

Figure 8:
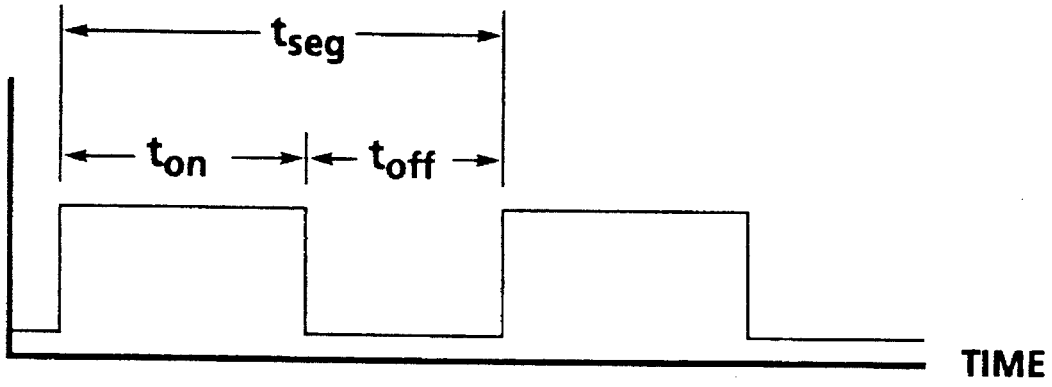
FIG. 8 is a timing diagram showing a fire bank signal which controls the firing of banks of nozzles on a printbar.

FIG. 8 illustrates the two states of the fire bank signal. As shown in FIG. 8, $T_{seg}$ indicates the entire time period of the fire bank signal. The portion labeled $T_{on}$ shows the active state of a first bank signal which controls the duration of the firing of the jets within a bank. The segment labeled $T_{off}$ is the period of time which is varied to determine the relative position of the drops on a page. It is this period, $T_{off}$, that will be adjusted by the central processing unit 97 using an algorithm that performs the operations shown in FIG. 9.

Figure 9:
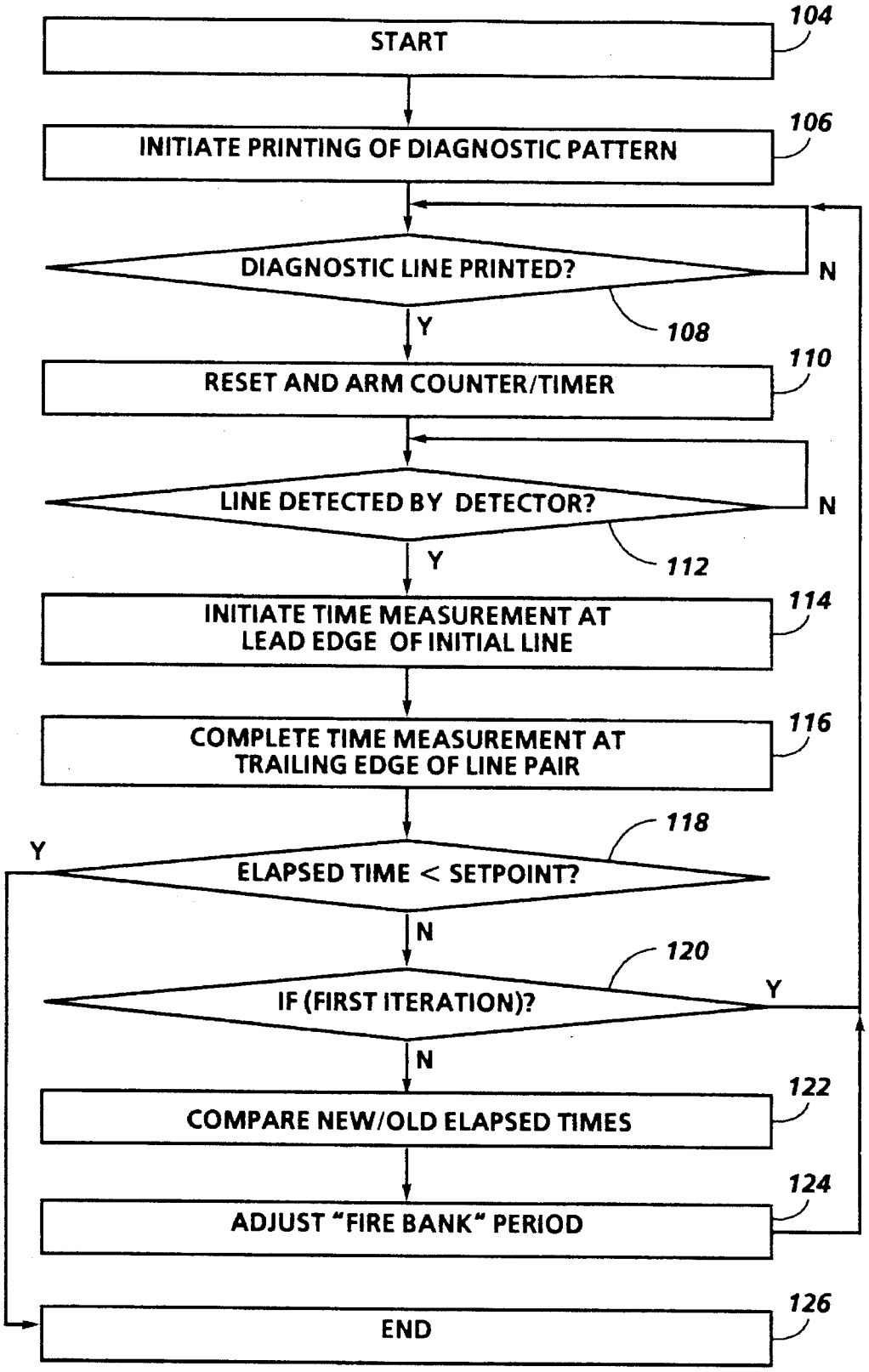
FIG. 9 is a flow diagram illustrating a procedure for automatically correcting the alignment of a segmented printbar.

Referring to FIG. 9, the processing steps of the present invention will now be described. After an operator initiates an alignment function by pressing an align button or through some other means shown as Step 104, the central processing unit 97 initiates printing of the previously described diagnostic pattern at Step 106. The CPU monitors the printing of the diagnostic pattern and at Step 108 determines whether or not the diagnostic pattern has been printed. If not, the CPU continues to monitor whether or not the diagnostic pattern has been printed. Once printed, the counter/timer 102 is reset and armed at step 110. After reset, movement of the scanning detector 100 is initiated by CPU 97 to scan across the diagnostic pattern. Until a line or a first portion of the diagnostic pattern is detected by the sensor 88, the CPU continues to monitor for a line at Step 112. Once a line is detected by the sensor 88, time measurement at Step 114 begins upon sensing the lead edge of the first line 78 and continues at Step 116 until the trailing edge of the line pair has been completed.

At this point, the counter/timer 102 receives assignment from the central processing unit 97 indicating completion of its timing of the test pattern. At Step 118 a decision is made to determine whether or not the elapsed time counted by the counter/timer 102 is less than a set point. The set point is a value stored in memory which indicates what amount of correction is necessary to achieve acceptable alignment. If the elapsed time is not less than the set point, then at Step 120 it is determined whether or not this measurement is the first iteration or first measurement of elapsed time. If yes, the diagnostic program returns to Step 108 and continues through Steps 108 through 120 as previously described. If, however, at Step 120, is it is determined that it is not the first iteration, then at Step 122, the newly determined time measurement is compared to the previously determined time measurements and at the time period of the fire bank signal is adjusted at Step 124. Once adjusted, a new diagnostic pattern is printed at Step 108 to determine if an actual improvement has been made in the print quality by recalculating elapsed time. Again, Steps 108 through 118 are completed and if at Step 118 the elapsed time or measured time is now less than the set point then the programs ends at Step 126 to complete the automatic correction. The steps described in FIG. 9 can be included in an embedded algorithm located in the CPU.

In recapitulation, there has been described an electronic autocorrection method for correction of misaligned segmented printbars in a thermal ink jet printer. Though this process has been described for a hypothetical printhead structure containing banks of four jets each, the present invention is not limited to such a structure. Any printhead design, where the jets are fired sequentially rather than simultaneously will benefit from the present invention. In addition, the present invention is not limited to ink jet printers, but may also be applied to other printing technologies as well where sequential printing of pixels is required.

It is, therefore, apparent that there has been provided in accordance with the present invention, a method for electronically correcting misaligned segmented printbars upon initiation of an align button or other means to improve the printing of segmented printbars during an analysis operation that fully satisfies the aims and advantages herein setforth. While this invention has been described in conjunction with a specific embodiment thereof, it is evident that many alternatives, modifications, and variations will be apparent to those skilled in the art. For instance, the present invention could also be applied to large array printhead structures also known as page width printhead structures. Accordingly, it is intended to embrace all such alternatives, modifications and any variations that fall within the spirit and broad scope of the appended claims.

We claim:

1. A method for adjusting printing alignment of a printer having a scanning printbar, scanning in a scanning direction, printing upon a recording medium advanced substantially perpendicularly to the scanning direction in which the printbar includes banks of nozzles sequentially printing line segments, comprising the steps of:

printing a pattern having an alignment feature indicative of the printing alignment on the recording medium;

moving a sensing device in the scanning direction across the pattern to generate an output indicative of the alignment feature of the pattern;

determining a value based on the generated output; and adjusting a time delay period between printing of sequentially printed line segments based on the value determined in said determining step.

2. The method of claim 1, wherein said printing step includes printing a pattern comprising a first line and a second line.

3. The method of claim 2, wherein said printing step includes printing a pattern comprising a first line and a second line partially overlapping in the scanning direction.

4. The method of claim 3, wherein said printing step includes advancing the recording medium a length equal to a partial length of the printbar to accomplish the partial overlapping.

5. The method of claim 4, wherein said printing step includes forming the first line and the second line with each being substantially equal in length to a line printed by the entire length of the printbar.

6. The method of claim 5, wherein said sensing step includes sensing whether a space exists between the first line and the second line of the pattern.

7. The method of claim 6, wherein said moving step includes moving a light sensing device comprising a single point sensor in the scan direction over the pattern.

8. The method of claim 7, further comprising the step of generating a signal indicative of the variation in light intensity from a point located before the first line to a point located after the second line of the pattern over time after said sensing step.

9. The method of claim 8, wherein said determining step further includes determining a value which minimizes the distance between the first line and the second line.

10. The method of claim 9, wherein said adjusting step further includes increasing the amount of time between the firing of adjacently located printbar segments.

11. The method of claim 1, wherein said moving step includes moving a sensing device in the scanning direction across the pattern to generate an output over time indicative of the alignment feature of the pattern.

12. The method of claim 11, wherein said moving step includes moving a single point sensor in the scan direction over the pattern.

13. An ink jet printer having a scanning printhead carriage moving in a scanning direction and a recording medium advanced substantially perpendicularly to the scanning direction of the scanning printhead carriage comprising:

a printhead attached to the printhead carriage, said printhead including a linear array of ink ejecting nozzles arranged in banks of nozzles in which said nozzles within said banks eject ink simultaneously and said banks of said nozzles eject ink sequentially;

printhead timing control means for controlling ejection of ink from said nozzles;

a single point sensor, generating an output signal, attached to the printhead carriage;

timing means coupled to said single point sensor for analyzing the generated output signal received from said single point sensor; and control means for determining a value based on the analyzed signal.

14. The ink jet printer of claim 13, wherein said control means controls said printhead timing control means based on the value determined by said control means.

15. The ink jet printer of claim 14, wherein said control means regulates said printhead to print a pattern having features indicative of printing quality.

16. The ink jet printer of claim 15, wherein the pattern includes a first line and a second line.

17. The ink jet printer of claim 16, wherein the first line partially overlaps the second line in the scanning direction.

18. The ink jet printer of claim 17 wherein said sensor includes a light emitting diode for illuminating the pattern and a photodiode for sensing whether a space exists between the first line and the second line of the pattern.

19. The ink jet printer of claim 18, further including a carriage control means for moving the carriage across the pattern.

20. The ink jet printer of claim 19, wherein said timing means includes a counter means for determining the distance between the first line and the second line based on the analyzed signal.

21. The ink jet printer of claim 20, wherein said control means generates a fire bank signal for controlling ink ejection from said nozzles.

22. A method of adjusting printing alignment in a printer printing upon a recording medium advanced perpendicularly to a scanning printbar, scanning in a scanning direction, tilted at an angle with respect to the advancing direction of the recording medium and having banks of nozzles sequentially printing line segments, comprising the steps of:

printing a first line and a second line on the recording medium, the second line partially overlapping the first line;

sensing a distance between overlapping portions of the first line and the second line with a single point sensor; and adjusting a time delay period between the printing of the sequentially printed line segments of the printbar as a function of the sensed distance to adjust printing alignment.

23. The method of claim 22, wherein said adjusting step further includes increasing the time delay period between the printing of adjacently located printed line segments.

24. The method of claim 23, wherein said printing step includes partially overlapping the second line with respect to the first line by advancing the recording medium a distance equal to a partial length of the printbar.

25. The method of claim 24, wherein said printing step includes printing the first line having a length equal to the length of the printbar.

26. The method of claim 25, wherein said printing step includes printing the second line having a length equal to the length of the printbar.

27. The method of claim 26, wherein said adjusting step further includes increasing the amount of time between the firing of adjacently located printbar segments.

* * * * *